United States Patent [19]

Petrov et al.

[11] 4,427,626

[45] Jan. 24, 1984

[54] METHOD OF MAKING PRODUCTS FROM POWDERS OF TOOL STEELS

[76] Inventors: Alexei K. Petrov, ulitsa Verkhnyaya, 9/27, kv. 7, Zaporozhie; Vladimir B. Akimenko, Prospekt Mira, 184, korpus 1, kv. 79, Moscow; Vladimir N. Zhuchin, ulitsa Lenina, 102, kv. 7, Elektrostal Moskovskoi oblasti; Alexei G. Tsipunov, prospekt Lenina, 151, kv. 160, Zaporozhie; Elena N. Smirnova, ulitsa Pobedy, 75, kv. 17, Zaporozhie; Jury N. Skornyakov, ulitsa Shkolnaya, 27, kv. 124, Zaporozhie; Alexandr F. Klimenko, ulitsa Komarova, 5, kv. 66, Zaporozhie, all of U.S.S.R.

[21] Appl. No.: 314,089

[22] PCT Filed: Feb. 13, 1980

[86] PCT No.: PCT/SU80/00021

§ 371 Date: Oct. 9, 1981

§ 102(e) Date: Oct. 9, 1981

[87] PCT Pub. No.: WO81/02264

PCT Pub. Date: Aug. 20, 1981

[51] Int. Cl.[3] ..... B22F 3/16

[52] U.S. Cl. ..... 419/28; 419/54; 419/57

[58] Field of Search ..... 75/224, 221, 208 R; 29/420.5; 419/8, 9, 54, 55, 31, 57

[56] References Cited

U.S. PATENT DOCUMENTS

| | | | |
|---|---|---|---|
| 3,411,902 | 11/1968 | Krock | 75/224 |
| 3,893,852 | 7/1975 | Bergman | 75/224 |
| 3,936,299 | 2/1976 | Steven | 75/224 |
| 3,997,341 | 12/1976 | Janowski | 75/224 |
| 4,069,042 | 1/1978 | Bucovecky | 75/208 R |
| 4,106,931 | 8/1978 | Nayer | 75/224 |
| 4,225,344 | 9/1980 | Fujimori | 75/224 |

FOREIGN PATENT DOCUMENTS

| | | |
|---|---|---|
| 417246 | 9/1973 | U.S.S.R. . |
| 418271 | 9/1972 | U.S.S.R. . |

*Primary Examiner*—L. Dewayne Rutledge
*Assistant Examiner*—J. J. Zimmerman
*Attorney, Agent, or Firm*—Fleit, Jacobson, Cohn & Price

[57] ABSTRACT

The method of the invention relates to powder metallurgy and is intended to be used for making cutting tools, dies as well as vital structural members.

The method comprises charging a powder into a capsule, sealing the capsule, heating and then extruding the capsule containing the powder. The sealed capsule is heated up to a temperature of 700° to 1000° C., whereupon the capsule is depressurized and heated up to a temperature of 1050° to 1200° C.

2 Claims, No Drawings

METHOD OF MAKING PRODUCTS FROM POWDERS OF TOOL STEELS

TECHNICAL FIELD

The present invention relates to powder metallurgy and particularly to the manufacture of products from tool steels.

BACKGROUND ART

Up to recently the quality of products from tool steels produced by conventional metallurgical methods was improved by way of complicating their chemical composition, which involved considerable difficulties caused by a sharp deterioration in the ductility of cast metal and a decrease in an ingot-to-product yield.

The use of improved production techniques and processes (electroslag remelting process, the use of large ingots and high-temperature treatment prior to deformation in presses, hot extrusion of ingots) has made it possible to somewhat increase the ingot-to-product yield and to upgrade its quality in a stage process of tool steels but has not allowed for the solution of the problem as a whole.

One of the ways of solving said problem is to produce products from tool steels by the method of powder metallurgy. Such steels are distinguished from the cast ones by the absence of chemical structural non-uniformity, by the size and character of distribution of carbides, which substantially improves the ductility of the steel, increases the ingot-to-product yield of metal and the operation characteristics of products.

Known in the art is a method of making products from stainless steel powders (see, for instance, USSR Inventor's Certificate No. 418,271, published on June 9, 1977), comprising charging a powder into a capsule, heating, sealing and deformation of the capsule. The capsule with the powder contained therein is heated up to the deformation temperature in the atmosphere of hydrogen and held at this temperature for 1 to 6 hours. Then the capsule is sealed in a furnace.

The described method makes it possible to reduce the oxides on the metal particles and to obtain metal of dense structure. However the necessity of using costly equipment in special furnaces with the atmosphere of highly-purified hydrogen the maintainance of which under the conditions of an increased explosion hazard requires special measures for ensuring safe operation and considerably impedes the industrial implicability.

Known in the art is a method of making products from high-speed steel (see Inventor's Certificate No. 417,246, published on June 9, 1972), comprising charging a powder into a capsule, pumping off air therefrom, sealing, heating and deformation of the capsule. This being the case, the capsule with the powder contained therein is heated up to a temperature of 1050° to 1150° C. and then extruded at a degree of deformation of 70 to 90%.

The method is comparatively cheap and simple. However, the presence of oxides in the deformed metal reduces its strength and operation characteristics. This takes place because, as a result of heating the capsule for deformation, reversible redox processes occur therein, which processes are due to the reduction of the oxides by carbon of the powder of the steel and formation of carbon oxide and carbon dioxide therewith. The carbon dioxide is an active oxidizer of metal.

The object of the invention is to provide a method of making products from powders of tool steels, wherein the production techniques and conditions make it possible to substantially reduce the content of oxides in the deformed metal and thereby to upgrade its strength and operation characteristics.

DISCLOSURE OF THE INVENTION

The object set forth is attained by that in a method of making products from powders of tool steels, comprising charging a powder into a capsule, sealing the capsule, heating and then extruding the capsule with the powder contained therein, according to the invention, the sealed capsule is heated up to a temperature of 700° to 1000° C., whereupon the capsule is depressurized and heated up to a temperature of 1050° to 1200° C.

In the course of heating the capsule with the powder of steel up to a temperature of 1050° to 1200° C. there occur reversible redox processes therein, during which processes there are formed gaseous products of the reducing reaction in the form of steam, vapours of carbon oxide and carbon dioxide. The latter are formed due to direct reduction of oxides by carbon of the steel, which oxides diffuse to the surface of a powder particle. Carbon dioxide is an active oxidizer, and the presence thereof in the capsule prevents the reduction of the oxides to a required degree, since there is observed a phenomenon of reoxidation. Removal of the gaseous products of the reducing reaction due to the depressurisation of the capsule in the indicated range of temperatures provides for a reduction of the oxides to a greater extent and improves the quality of the powdered metal.

It is advisable that prior to sealing the capsule containing the powder be filled up with nitrogen under a pressure of 1 to $5 \cdot 10^5$ Pa. This allows the time of heating the capsule for deformation to be reduced by 10 to 20% due to improved conditions of heat conductivity.

Best Mode of Carrying out the Invention

A product from the powder of tool steel, according to the invention, is manufactured in the following manner.

Sprayed powder of tool steel (the powder size being not more than 800 μm) is charged into a cylindrical capsule provided with an opening in its cover. The capsule and the cover are made from low-carbonaceous steel. Then the capsule is filled up with nitrogen under a pressure of 1 to $5 \cdot 10^5$ Pa, whereupon it is sealed by soldering the opening, the melting temperature of the solder being of 700° to 1000° C. Thus prepared capsule is heated up in an electric chamber furnace to a temperature of 1050° to 1200° C. for 4 to 14 hours. The preliminary filling the capsule with nitrogen allows the time of its heating for deformation to be reduced by 10 to 20%. This is due to improvement in the conditions of heat conductivity. In the course of heating the solder melts and the capsule depressurizes. Being heated up as described above the capsule containing the powder is subjected to extrusion through a die. As a result, rods of 30 to 150 mm in diameter are obtained, which are then annealed.

From the metal rods obtained as described above there are made test specimens which are subjected to hardening and triple tempering (the temperature conditions of the hardening and tempering depend on the properties which are to be imparted to the tool). Then the specimens are subjected to testing to determine the hardness, impact viscosity and bending strength thereof.

The testing procedures are given hereinbelow.

To determine the bending strength of the material there are made test specimens, which specimens are 6×6×50 mm bars. These bars are subjected to thermal treatment (hardening, triple tempering). Said specimens are bent in a special device. Said device is made in the form of two supports, the distance therebetween being 40 mm, and a punch mounted between the supports and connected with a hydraulic press. The supports and the working part of the punch are provided with rounded off portions, the radius of the rouded off portions of the supports being 15 mm and the radius of the rouded off portion of the punch being 7.5 mm.

The test specimen is placed onto the supports and with the aid of the punch is bent till it is broken. The speed of the punch is 0.1 mm/s. The bending force is registered by the indicator of the press at the moment of breakage of the test specimen.

The bending strength of the products is determined by the formula:

$$\sigma = \frac{M_n}{W} = \frac{3Pl}{bW^2}$$

where:

$M_n$—bending moment, kg·mm;

$W=(b\cdot n^2)/6$—moment of resistance, $mm^3$;

P—bending force at the moment of breakage of the test specimen, kg;

l—distance between the supports, mm;

b—width of the test specimen after breakage thereof, mm;

h—height of the test specimen after breakage thereof, mm.

To determine impact viscosity of the material, 10×10×55 mm bars are made from the obtained products, which bars are subjected to thermal treatment (hardening, triple tempering).

Said test specimens are tested with the aid of an impact testing machine. The work of the impact of the pendulum of the impact testing machine is 30 kgm. The pendulum hits the specimen being tested until it is broken, whereupon the cross-section of the specimen is measured at the place of breakage. The work of the impact of the pendulum is determined by an indicator at the moment of breakage of the test specimen.

Impact viscosity of the material is determined by the formula:

$$\alpha = \frac{A}{F}\ \mathrm{kgf/cm^2}$$

where:

A—work of the impact of the pendulum of the impact testing machine at the moment of breakage of the test specimen, kgm;

F—cross-sectional area of the test specimen at the place of breakage, $cm^2$.

EXAMPLE 1

A product from powder of tool steel comprising in % by weight: C, 1.0; Mn, 0.4; Si, 0.4; Cr, 3.9; W, 6.0; Mo, 4.8; V, 1.7; Co, 4.8; S, 0.03; P, 0.03; Fe, the balance, according to the invention, was made in the following way.

The sprayed powder of said steel having a particle size of to 800 μm) was charged into a capsule from low-carbonaceous steel containing in % by weight: C, 0.2; Mn, 0.6; Si, 0.3; P, 0.04; S, 0.05; Fe, the balance. The capsule was 300 mm in diameter and 700 mm in height and provided with an opening in the cover thereof, intended for outlet of gaseous products. Then the capsule was filled with nitrogen under a pressure of $1\cdot10^5$ Pa, whereupon it was sealed by soldering the opening, the solder having a melting temperature of 900° C. and containing in % by weight: Zn, 35.0; Ni, 5.0; Cu, 60.0. Thus prepared capsule was heated in an electric chamber furnace to a temperature of 1150° C. for 12 hours. In the course of heating the solder melt and, as a result, the capsule became depressurized.

Being heated up, the capsule containing the powder was subjected to extrusion to produce rods of 100 mm in diameter through a die at an extrusion force of 6300 ton-forces.

The density of the obtained powder was 100%.

The obtained rods were subjected to annealing under the following working conditions:

heating to a temperature of 850° C. and holding at this temperature for 4 hours;

cooling to a temperature of 500° C. at a rate of not more than 20° C./hr;

further cooling in the air.

From the metal rods obtained as described above there were made test specimens. Said specimens were subjected to hardening at a temperature of 1120° C. and to triple tempering at a temperature of 540° C.

Then the specimens were tested to determine the hardness, impact viscosity and bending strength thereof.

The results of the tests were as follows:

hardness, HRC . . . 68 impact viscosity, $kgm/cm^2$ . . . 2.2 bending strength, $kg/mm^2$ . . . 350

EXAMPLE 2

The same as in Example 1, but the specimens were subjected to hardening at a temperature of 1220° C. and to triple tempering at a temperature of 520° C.

Then the specimens were tested to determine the hardness, impact viscosity and bending strength thereof.

The results of the tests were the following:

hardness, HRC . . . 67 impact viscosity, $kgm/cm^2$ . . . 1.8 bending strength, $kg/mm^2$ . . . 300

EXAMPLE 3

The same as in Example 1, but the specimens were subjected to hardening at a temperature of 1220° C. and to triple tempering at a temperature of 560° C.

Then the specimens were tested to determine the hardness, impact viscosity and bending strength thereof.

The results of the tests were the following:

hardness, HRC . . . 67 impact viscosity, $kgm/cm^2$ . . . 2.0 bending strength, $kg/mm^2$ . . . 320

EXAMPLE 4

The same as in Example 1, but the specimens were subjected to hardening at a temperature of 1240° C. and to triple tempering at a temperature of 540° C.

Then the specimens were tested to determine the hardness, impact viscosity and bending strength thereof.

The results of the tests were the following:
hardness, HRC . . . 68
impact viscosity, kgm/cm$^2$ . . . 1.4
bending strength, kg/mm$^2$ . . . 240

EXAMPLE 5

The same as in Example 1, but the specimens were subjected to hardening at a temperature of 1240° C. and to triple tempering at a temperature of 540° C.

Then the specimens were tested to determine the hardness, impact viscosity and bending strength thereof.

The results of the tests were the following:
hardness, HRC . . . 68
impact viscosity, kgm/cm$^2$ . . . 1.9
bending strength, kg/mm$^2$ . . . 280

EXAMPLE 6

The same as in Example 1, but the specimens were subjected to hardening at a temperature of 1240° C. and to triple tempering at a temperature of 560° C.

Then the specimens were tested to determine the hardness, impact viscosity and bending strength thereof.

The results of the tests were the following:
hardness, HRC . . . 67
impact viscosity, kgm/cm$^2$ . . . 1.7
bending strength, kgm/cm$^2$ . . . 250

EXAMPLE 7

The same as in Example 1, but the specimens were subjected to hardening at a temperature of 1200° C. and to triple tempering at a temperature of 520° C.

Then the specimens were tested to determine the hardness, impact viscosity and bending strength thereof.

The results of the tests were the following:
hardness, HRC . . . 65
impact viscosity, kgm/cm$^2$ . . . 1.9
bending strength, kg/mm$^2$ . . . 310

EXAMPLE 8

The same as in Example 1, but the test specimens were subjected to hardening at a temperature of 1200° C. and to triple tempering at a temperature of 540° C.

Then the specimens were tested to determine the hardness, impact viscosity and bending strength thereof.

The results of the tests were the following:
hardness, HRC . . . 68
impact viscosity, kgm/cm$^2$ . . . 2.5
bending strength, kg/mm$^2$ . . . 370

EXAMPLE 9

The same as in Example 1, but the test specimens were subjected to hardening at a temperature of 1200° C. and to triple tempering at a temperature of 560° C.

Then the specimens were tested to determine the hardness, impact viscosity and bending strength thereof.

The results of the tests were the following:
hardness, HRC . . . 67
impact viscosity, kgm/cm$^2$ . . . 2.2
bending strength, kg/mm$^2$ . . . 340

EXAMPLE 10

A product from powder of tool steel comprising in % by weight: C, 1.27; Si, 0.4; Mn, 0.4; Cr, 4.4; Ni, 0.4; W, 12.5; Mo, 3.4; V, 2.4; Co, 8.5; S, 0.03; P, 0.03; Fe, the balance, according to the invention, was made in the following way.

The sprayed powder of said steel having a particle size of 800 μm was charged into a capsule from low-carbonaceous steel containing in % by weight: C, 0.2; Mn, 0.6; Si, 0.3; P, 0.04; S, 0.05; Fe, the balance. The capsule was 95 mm in diameter and 400 mm in height and provided with an opening in the cover thereof, intended for outlet of gaseous products. Then the capsule was filled with nitrogen under a pressure of $5 \cdot 10^5$ Pa, whereupon it was sealed by soldering the opening, the solder having a melting temperature of 900° C. and containing in % by weight: Zn, 35.0; Ni, 5.0; Cu, 60.0. Thus prepared capsule was heated in an electric chamber furnace to a temperature of 1150° C. for 5 hours. In the course of heating the solder melted and, as a result, the capsule became depressurized.

Being heated up, the capsule containing the powder was subjected to extrusion to produce rods of 300 mm in diameter through a die at an extrusion force of 2000 ton-forces.

The density of the obtained powder was 100%.

The obtained rods were subjected to annealing under the following working conditions:

heating to a temperature of 850° C. and holding at this temperature for 4 hours;

cooling to a temperature of 500° C. at a rate of not more than 20° C./hr;

further cooling in the air.

From the metal rods obtained as described above there were made test specimens. Said specimens were subjected to hardening at a temperature of 1240° C. and to triple tempering at a temperature of 540° C.

Then the specimens were tested to determine the hardness, impact viscosity and bending strength thereof.

The results of the tests were as follows:
hardness, HRC . . . 68
impact viscosity, kgm/cm$^2$ . . . 1.6
bending strength, kg/mm$^2$ . . . 300

EXAMPLE 11

A product from powder of tool steel comprising in % by weight: C, 1.0; Mn, 0.4; Si, 0.4; Si, 0.4; Cr, 3.9; W, 6.0; Mo, 4.8; V, 1.7; Co, 4.8; S, 0.03; P, 0.03; Fe, the balance, according to the invention, was made in the following way.

The sprayed powder of said steel having a particle size of 800 μm was charged into a capsule from low-carbonaceous steel containing in % by weight: C, 0.02; Mn, 0.6; Si, 0.3; P, 0.04; S, 0.05; Fe, the balance. The capsule was 300 mm in diameter and 700 mm in height and provided with an opening in the cover thereof, intended for outlet of gaseous products. Then the capsule was filled with nitrogen under a pressure of $1 \cdot 10^5$ Pa, whereupon it was sealed by soldering the opening, the solder having a melting temperature of 1130° C. and containing in % by weight: P, 6.0; Sn, 3.0; Zn, 2.0; Cu, 89.0. Thus prepared capsule was heated in an electric chamber furnace to a temperature of 1130° C. for 12 hours. In the course of heating the solder melt at a temperature of 700° C. and, as a result, the capsule became depressurized.

Being heated up as described above, the capsule containing the powder was subjected to extrusion to produce rods of 100 mm in diameter through a die at an extrusion force of 6300 ton-forces.

The density of the obtained powder was 100%.

The obtained rods were subjected to annealing under the following working conditions:

heating to a temperature of 850° C. and holding at this temperature for 4 hours;

cooling to a temperature of 500° C. at a rate of not more than 20° C./hr;

further cooling in the air.

From the metal rods obtained as described above there were made test specimens. Said specimens were subjected to hardening at a temperature of 1220° C. and to triple tempering at a temperature of 520° C.

Then the specimens were tested to determine the hardness, impact viscosity and bending strength thereof.

The results of the tests were the following:

hardness, HRC . . . 67 impact viscosity, kgm/cm$^2$ . . . 1.8 bending strength, kg/mm$^2$ . . . 300.

EXAMPLE 12

The same as in Example 11, but the test specimens were subjected to triple tempering at a temperature of 540° C.

Then the specimens were tested to determine the hardness, impact viscosity and bending strength thereof.

The results of the tests were the following:

hardness, HRC . . . 6.8 impact viscosity, kgm/cm$^2$ . . . 2.0 bending strength, kg/mm$^2$ . . . 320

EXAMPLE 13

A product from powder of tool steel comprising in % by weight: C, 1.1; Mn, 0.3; Si, 0.3; Cr, 4.4; W, 7.0; Mo, 5.3; V, 2.1; Co, 5.3; S, 0.02; P, 0.02; Fe, the balance, according to the invention, was made in the following way.

The sprayed powder of said steel having a particle size of 800 μm was charged into a capsule from low-carbonaceous steel containing in % by weight: C, 0.2; Mn, 0.6; Si, 0.3; P, 0.04; S, 0.05; Fe, the balance. The capsule was 300 mm in diameter and 700 mm in height and provided with an opening in the cover thereof, intended for outlet of gaseous products. Then the capsule was filled with nitrogen under a pressure of $1 \cdot 10^5$ Pa, whereupon it was sealed by soldering the opening, the solder having a melting temperature of 1000° C. and containing in % by weight: Fe, 5.0; Si, 5.0; Ni, 20.0; Cu, 80.0. Thus prepared capsule was heated in an electric chamber furnace to a temperature of 1130° C. for 12 hours. In the course of heating the solder melt at a temperature of 1000° C. and, as a result, the capsule became depressurized.

Being heated up as described above, the capsule containing the powder was subjected to extrusion to produce rods of 100 mm in diameter through a die at an extrusion force of 6300 ton-forces.

The density of the obtained powder metal was 100%.

The obtained rods were subjected to annealing under the following working conditions:

heating to a temperature of 850° C. and holding at this temperature for 4 hours;

cooling to a temperature of 500° C. at a rate of not more than 20° C./hr;

further cooling in the air.

From the metal rods obtained as described above there were made test specimens. Said specimens were subjected to hardening at a temperature of 1220° C. and to triple tempering at a temperature of 520° C.

Then the specimens were tested to determine the hardness, impact viscosity and bending strength thereof.

The results obtained were the following:

hardness, HRC . . . 67 impact viscosity, kgm/cm$^5$ . . . 1.8 bending strength, kg/mm$^2$ . . . 290

EXAMPLE 14

The same as in Example 13, but the test specimens were subjected to triple tempering at a temperature of 540° C.

Then the specimens were tested to determine the hardness, impact viscosity and bending strength thereof.

The results of the tests were the following:

hardness, HRC . . . 68 impact viscosity, kgm/cm$^2$ . . . 2.0 bending strength, kg/mm$^2$ . . . 310

EXAMPLE 15

A product from powder of tool steel comprising in % by weight: C, 1.1; Mn, 0.3; Si, 0.3; Cr, 4.4; W, 7.0; Mo, 5.3; V, 2.1; Co, 5.3; S, 0.02; P, 0.02; Fe, the balance, according to the invention, was made in the following way.

The sprayed powder of said steel having a particle size of 800 μm was charged into a capsule from low-carbonaceous steel containing in % by weight: C, 0.2; Mn, 0.6; Si, 0.3; P, 0.04; S, 0.05; Fe, the balance. The capsule was 300 mm in diameter and 700 mm in height and provided with an opening in the cover thereof, intended for outlet of gaseous products. Then the capsule was filled with nitrogen under a pressure of $1 \cdot 10^5$ Pa, whereupon it was sealed by way of soldering the opening, the solder having a melting temperature of 900° C. and containing in % by weight: Zn, 35.0; Ni, 5.0; Cu, 60.0. Thus prepared capsule was heated in an electric chamber furnace to a temperature of 1050° C. for 12 hours. In the course of heating the solder melted at a temperature of 900° C. and, as a result, the capsule became depressurized.

Being heated up as described above, the capsule containing the powder was subjected to extrusion to produce rods of 100 mm in diameter through a die at an extrusion force of 6300 ton-forces.

The density of the obtained powder metal was 100%.

The obtained rods were subjected to annealing under the following conditions:

heating to a temperature of 850° C. and holding at this temperature for 4 hours;

cooling to a temperature of 500° C. at a rate of not more than 20° C./hr;

further cooling in the air.

From the metal rods obtained as described above there were made test specimens. Said specimens were subjected to hardening at a temperature of 1220° C. and to triple tempering at a temperature of 520° C.

Then the specimens were tested to determine the hardness, impact viscosity and bending strength thereof.

The results obtained were the following:
hardness, HRC . . . 67
impact viscosity, kgm/cm$^2$ . . . 1.4
bending strength, kg/mm$^2$ . . . 270

EXAMPLE 16

The same as in Example 15, but the test specimens were subjected to triple tempering at a temperature of 540° C.

Then the test specimens were tested to determine the hardness, impact viscosity and bending strength thereof.

The results of the tests were the following.
hardness, HRC . . . 68
impact viscosity, kgm/cm$^2$ . . . 1.6
bending strength, kg/mm$^2$ . . . 290

EXAMPLE 17

A product from powder of tool steel comprising in % by weight: C, 1.0; Mn, 0.2; Si, 0.2; Cr, 3.1; W, 6.5; Mo, 5.1; V, 2.0; Co, 5.1; S, 0.01; P, 0.1; Fe, the balance, according to the invention, was obtained in the following way.

The sprayed powder of said steel having a particle size of 800 μm was charged into a capsule from low-carbonaceous steel containing in % by weight: C, 0.2; Mn, 0.6; Si, 0.3; P, 0.04; S, 0.05; Fe, the balance. The capsule was 300 mm in diameter and 700 mm in height and provided with an opening in the cover thereof, intended for outlet of gaseous products. Then the capsule was filled with nitrogen under a pressure of $1 \cdot 10^5$ Pa, whereupon it was sealed by way of soldering the opening, the solder having a melting temperature of 900° C. and containing in % by weight: Zn, 35.0; Ni, 5.0; Cu, 60.0. Thus prepared capsule was heated in an electric chamber furnace to a temperature of 1200° C. for 12 hours. In the course of heating the solder melted at a temperature of 900° C. and, as a result, the capsule became depressurized.

Being heated up as described above, the capsule containing the powder was subjected to extrusion to produce rods of 100 mm in diameter through a die at an extrusion force of 6300 ton-forces.

The density of the obtained powder metal was 99.90%.

The obtained rods were subjected to annealing under the conditions similar to those described in Example 1.

From the rods obtained as described above there were made test specimens. Said specimens were subjected to hardening at a temperature of 1200° C. and to triple tempering at a temperature of 520° C.

Then the specimens were tested to determine the hardness, impact viscosity and bending strength thereof.

The results of the tests were the following:
hardness, HRC . . . 67
impact viscosity, kgm/cm$^2$ . . . 1.5
bending strength, kg/mm$^2$ . . . 270.

EXAMPLE 18

The same as in Example 17, but the test specimens were subjected to triple tempering at a temperature of 540° C.

Then the test specimens were tested to determine the hardness, impact viscosity and bending strength thereof.

The results of the tests were the following:
hardness, HRC . . . 68
impact viscosity, kgm/cm$^2$ . . . 1.7
bending strength, kg/mm$^2$ . . . 280.

EXAMPLE 19

The same as in the Example 17, but the capsule was filled with nitrogen under a pressure of $3 \cdot 10^5$ Pa, whereupon it was sealed by way of soldering the opening, the solder having a melting temperature of 900° C. and containing in % by weight: Zn, 35.0; Ni, 5.0; Cu, 60.0. Thus prepared capsule was heated in an electric chamber furnace to a temperature of 1140° C. for 12 hours. In the course of heating the solder melt at a temperature of 900° C. and, as a result, the capsule became depressurized.

Being heated up as described above, the capsule containing the powder was subjected to extrusion to produce rods of 100 mm in diameter through a die at an extrusion force of 6300 ton-forces.

The density of the obtained powder metal was 100%.

The obtained rods were subjected to annealing under the conditions similar to those described in Example 1.

From the rods obtained as described above there were made test specimens. Said specimens were subjected to hardening at a temperature of 1220° C. and to triple tempering at a temperature of 540° C.

Then the specimens were tested to determine the hardness, impact viscosity and bending strength thereof.

The results of the tests were the following:
hardness, HRC . . . 68
impact viscosity, kgm/cm$^2$ . . . 2.2
bending strength, kg/mm$^2$ . . . 350

EXAMPLE 20 (NEGATIVE)

A product from powder of tool steel comprising in % by weight: C, 1.0; Mn, 0.4; Si, 0.4; Cr, 3.9; W, 6.0; Mo, 4.8; V, 1.7; Co, 4.8; S, 0.03; P, 0.03; Fe, the balance, was made as described in Example 1. However, as distinct from the production procedure of the present invention, the capsule containing the powder of the above steel was filled with nitrogen under a pressure of $0.5 \cdot 10^5$ Pa, whereupon it was sealed by soldering it with a solder the composition of which in % by weight is indicated in Example 1. Thus prepared capsule was heated in an electric chamber furnace to a temperature of 1130° C. Under such working conditions the heat conductivity of the capsule lowered and, as a result, the time of its heating increased up to 14 hours.

This causes deterioration of mechanical and operation properties of a ready product because of higher content of carbides therein, and to an increase in the technological cycle and to higher power expenditures.

EXAMPLE 21 (NEGATIVE)

A product from powder of tool steel comprising in % by weight: C, 1.1; Mn, 0.03; Si, 0.03; Cr, 4.2; W, 6.5; Mo, 5.2; V, 2.0; Co, 5.2; S, 0.02; P, 0.02; Fe, the balance was made substantially as described in Example 13. However, as distinct from the production procedure, the capsule containing the powder of the above steel was filled with nitrogen under a pressure of $5.5 \cdot 10^5$ Pa, whereupon it was sealed by way of soldering the opening with a solder which composition and weight in % is indicated in Example 1. Thus prepared capsule was heated in an electrical chamber furnace to a temperature of 1130° C.

Under such conditions of heating the shape of the capsule was distorted, which prevented the extrusion from being carried out.

EXAMPLE 22 (NEGATIVE)

A product from powder of tool steel comprising in % by weight: C, 1.1; Mn, 0.1; Si, 0.1; Cr, 4.1; W, 6.3; Mo, 5.0; V, 2.0; Co, 5.2; S, 0.01; P, 0.01; Fe, the balance, was made substantially as described in Example 1. However, as distinct from the production production procedure of the invention, the capsule was depressurized at a temperature of 650° C. In so doing, a solder was used comprising in % by weight: P, 9.0; Cu, 78.0; Ni, 13.0. The melting temperature of the solder was 650° C. Then the process proceeded as described in Example 1.

The density of the obtained powdered metal was 99.90%.

The specimens were tested to determine the hardness, impact viscosity and bending strength thereof.

The results of the tests were the following:

hardness, HRC . . . 67 impact viscosity, kgm/cm$^2$ . . . 1.1 bending strength, kg/mm$^2$ . . . 220

Under such operation conditions of depressurization of the capsule there takes place oxidation of the powder, which impairs the mechanical and operation properties of a ready product.

EXAMPLE 23 (NEGATIVE)

A product from powder of tool steel comprising in % by weight: C, 1.1; Mn, 0.1; Si, 0.1; Cr, 4.1; W, 6.3; Mo, 5.0; V, 2.0; Co, 5.2; S, 0.01; P, 0.01; Fe, the balance, was made substantially as described in Example 1. However, as distinct from the production procedure of the invention, the capsule was depressurized at a temperature of 1050° C. In so doing, a solder was used comprising in %: Si, 5.0; Ni, 30.0; Cu, 60.0; Fe, 5.0. The melting temperature of the solder was 1050° C. Then the process proceeded as described in Example 1.

The density of the obtained powdered metal was 99.90%.

The specimens were tested to determine the hardness, impact viscosity and bending strength thereof.

The results of the tests were the following:

hardness, HRC . . . 67 impact viscosity, kgm/cm$^2$ . . . 1.2 bending strength, kg/mm$^2$ . . . 230

Such conditions of depressurization lead to incomplete reduction of oxides because of partial sintering of the powder, which results in deterioration of mechanical and operation properties of a ready product.

EXAMPLE 24 (NEGATIVE)

A product from powder of tool steel comprising in % by weight: C, 1.1; Mn, 0.4; Si, 0.4; Cr, 4.4; W, 7.0; Mo, 5.3; V, 2.1; Co, 5.3; S, 0.03; P, 0.03; Fe, the balance was made substantially as described in Example 1.

The density of the obtained powdered metal was 99.90%.

The specimens were tested to determine the hardness, impact viscosity and bending strength thereof.

The results of the tests were the following:

hardness, HRC . . . 67 impact viscosity, kgm/cm$^2$ . . . 1.0 bending strength, kg/mm$^2$ . . . 230

Such conditions of heating the capsule lead to incomplete of mechanical reduction of oxides on the surface of the powder, which leads to deterioration and operation properties of a ready product.

EXAMPLE 25 (NEGATIVE)

A product from powder of tool steel comprising in % by weight: C, 1.0; Mn, 0.4; Si, 0.4; Cr, 3.9; W, 6.0; Mo, 4.8; V, 1.7; Co, 4.8; S, 0.03; P, 0.03; Fe, the balance, was made substantially as described in Example 1. However, as distinct from the production procedure of the invention, the capsule was heated in an electrical chamber furnace to a temperature of 1220° C. Further on the process proceeded as described in Example 1.

The density of the obtained powdered metal was 99.90%.

The specimens were tested to determine the hardness, impact viscosity and bending strength thereof.

The results of the tests were the following:

hardness, HRC . . . 67 impact viscosity, kgm/cm$^2$ . . . 0.8 bending strength, kg/mm$^2$ . . . 210

Such conditions of heating the capsule lead to deterioration of mechanical and operation properties of a ready product

INDUSTRIAL APPLICABILITY

The proposed method is intended for making cutting tools, dies, as well as vital structural members.

We claim:

1. A method of making products from powders of tool steels, comprising charging a powder into a capsule, sealing the capsule, heating and then extruding the capsule with the powder contained therein, wherein the heating of said sealed capsule is carried out in two steps wherein said sealed capsule is first heated up to a temperature of 700° to 1000° C., whereupon it is then depressurized and heated up to a temperature of 1050° to 1200° C.

2. A method as claimed in claim 1, wherein the capsule containing the powder is filled with nitrogen at a pressure of 1 to $5 \cdot 10^5$ Pa prior to sealing.

* * * * *